US007694805B2

(12) United States Patent
Schneider et al.

(10) Patent No.: US 7,694,805 B2
(45) Date of Patent: Apr. 13, 2010

(54) GUARD ASSEMBLY AND RELATED METHODS

(75) Inventors: Jerry Glenn Schneider, Sycamore, IL (US); Toby Frelich, Saint Michael, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 11/958,395

(22) Filed: Dec. 18, 2007

(65) Prior Publication Data

US 2009/0154995 A1 Jun. 18, 2009

(51) Int. Cl.
*B65G 21/22* (2006.01)
*E01C 19/18* (2006.01)

(52) U.S. Cl. ..... 198/836.1; 198/525; 198/562; 198/566; 404/108

(58) Field of Classification Search ..... 198/836.1, 198/836.3, 836.4, 525, 562, 566; 404/108–110
See application file for complete search history.

(56) References Cited

U.S. PATENT DOCUMENTS

| | | | | |
|---|---|---|---|---|
| 2,591,502 | A | 4/1952 | Bohannan et al. | |
| 2,983,362 | A * | 5/1961 | Crist, Jr. | 198/547 |
| 3,453,939 | A | 7/1969 | Pollitz et al. | |
| 3,967,912 | A | 7/1976 | Parker | |
| 3,997,277 | A | 12/1976 | Swisher, Jr. et al. | |
| 4,321,996 | A * | 3/1982 | Sancken et al. | 198/499 |
| 4,405,089 | A | 9/1983 | Taylor | |
| 4,819,790 | A * | 4/1989 | Adcock | 198/811 |
| 5,452,966 | A | 9/1995 | Swisher, Jr. | |
| 5,458,230 | A * | 10/1995 | Balcar | 198/836.3 |
| 5,529,434 | A | 6/1996 | Swisher, Jr. | |
| 5,533,828 | A | 7/1996 | Campbell | |
| 5,533,829 | A | 7/1996 | Campbell | |
| 5,553,969 | A | 9/1996 | Reed | |
| 5,722,790 | A | 3/1998 | Spray | |
| 6,079,901 | A * | 6/2000 | Banks et al. | 404/108 |
| 6,481,925 | B1 | 11/2002 | Olson | |
| 6,591,973 | B2 * | 7/2003 | Smith | 198/550.2 |
| 7,500,806 | B2 * | 3/2009 | Higgins | 405/117 |
| 2004/0094384 | A1 * | 5/2004 | Shaw et al. | 193/35 R |
| 2008/0000757 | A1 | 1/2008 | Maguire | |
| 2008/0197000 | A1 * | 8/2008 | Andreoli | 198/836.3 |

FOREIGN PATENT DOCUMENTS

| | | |
|---|---|---|
| EP | 1834904 | 9/2007 |
| JP | 2003252419 | 9/2003 |

* cited by examiner

*Primary Examiner*—Mark A Deuble
(74) *Attorney, Agent, or Firm*—Joanna Xuqiong Wu; William A. Beckman; Carl E. Myers

(57) ABSTRACT

This disclosure provides a guard assembly and its individual guards for protecting a conveyor system, such as the center conveyor frame. Related methods of installing or removing the individual guards and the guard assembly are also provided.

19 Claims, 5 Drawing Sheets

GUARD ASSEMBLY AND RELATED METHODS

TECHNICAL FIELD

This disclosure relates, generally, to a guard assembly for protecting parts of a conveyor system from the bulk material being transferred by the conveyor system, and more particularly, to a guard assembly having a plurality of individual guards.

BACKGROUND

A machine may include a conveyor system for receiving material from a source in a hopper and then transferring the material to a predetermined destination. For example, when building roadways, paving machines may be used to deposit significant amounts of paving material. A conveyor system on a paver transfers the paving material from the paver hopper for discharge onto the roadbed. A typical paving material includes asphalt or asphalt concrete.

An asphalt paver at the construction site is generally a state-of-the-art self-propelled construction machine designed to receive, convey, distribute, profile and partially compact the asphalt material. The paver accepts the asphalt material into a receiving hopper at the front of the machine, conveys the material from the hopper to the rear of the machine with parallel slat conveyors, distributes the asphalt material along the width of an intended ribbon or mat by means of two opposing screw or spreading conveyors, and profiles and compacts the asphalt material into a mat with a free-floating screed.

Each slat conveyor that moves the asphalt material from the receiving hopper to the rear of the paving machine generally consists of two parallel slat chains with a multitude of transverse slats connected therebetween. Each slat chain is pulled by one of two sprockets mounted on a common shaft which, in turn, is driven by appropriate power transmission chains, gear boxes or the like.

Asphalt itself is usually a black and highly viscous liquid or semi-solid. It is present in most crude petroleums and in some natural deposits. When used in road construction, asphalt usually functions as a binder for a gravel or rock base. The raw material mixture is referred to as a "bituminous aggregate," and the finished road surfacing material is usually called "asphalt concrete." The bituminous aggregate is typically stored and transported at temperatures around 150° C. to prevent hardening. Thus, the asphalt material conveyor system needs to withstand the high-temperature and rough gravel or rock particles bound within the aggregate the mix is being dumped into the hopper, and more particularly, as the abrasive mix moves through the conveyor system. It is also desirable to have a conveyor system with features that facilitate the transfer of the molten aggregate material from the hopper to the roadbed to minimize the amount of leftover asphalt material (which forms cold asphalt build-up) in the conveyor system.

U.S. Pat. No. 3,453,939 describes two conveyors on a paver that are separated by a horizontal wall and paving material is confined thereon by shield plates inclined downwardly from the side walls and a divider wall between the two conveyors. The shield plates appear to protect the side walls and the divider walls from the paving material. But it is not clear whether or how these shield plates can be readily or individually removed when repair or replacement is needed.

For other conveyor systems, it may also be desirable to include a shield or guard system to protect certain parts of the conveyor systems from the bulk material they are designed to transfer.

The present disclosure is directed to addressing one or more needs discussed above.

SUMMARY OF THE INVENTION

A first aspect of the present disclosure provides a guard for protecting a conveyor frame or walls of a hopper wall and diverting material toward a conveyor system. The guard includes a first support member and a diverter member. The diverter member may have an end attached to the first support member and defining a material diverter surface thereon. The material diverter surface is positioned to direct material away from the conveyor frame or the hopper wall and towards the conveyor system. The diverter member defines an access portion therein and is configured to enclose a fastener assembly therein.

Another aspect of the present disclosure provides a guard assembly for protecting a conveyor frame or a hopper wall. The guard assembly includes at least two individual guards. Each of the individual guard includes a first support member and a diverter member. The diverter member may have an end attached to the first support member and defining a material diverter surface thereon. The material diverter surface is positioned to direct material away from the conveyor frame or the hopper wall and towards the conveyor system. The diverter member defines an access portion therein and is configured to enclose a fastener assembly therein. The at least two individual guards may be situated opposite to each other and attached to either side of the conveyor frame.

A further aspect of the present disclosure is directed to a conveyor system for receiving bulk material therein and directing the bulk material to a selected destination. The conveyor system includes first and second hopper walls and a moveable conveyor belt positioned thereunder. The conveyor system further includes a conveyor frame to support the moveable conveyor belt. The conveyor system also includes at least one removeable guard defining a material diverter surface, the material diverter surface being positioned to direct the bulk material away from the conveyor frame or the first and second hopper walls and towards the moveable conveyor belt. The at least one guard may be removeably attached to the conveyor frame or the first and second hopper walls through a fastener assembly at least partially recessed relative to the material diverter surface.

An additional aspect of the present disclosure provides a method for installing a guard for protecting a conveyor frame or a hopper wall and diverting material toward a conveyor system. The guard includes a first support member and a diverter member. The diverter member may have an end attached to the first support member and defining a material diverter surface thereon. The material diverter surface is positioned to direct material away from the conveyor frame or the hopper wall and towards the conveyor system. The diverter member defines an access portion therein and is configured to enclose a fastener assembly therein. The method includes attaching the guard to the conveyor frame or the hopper wall by securing the fastener assembly to the conveyor frame or the hopper wall through the access portion. The first support member of the guard may further include one or more dowels, and the method accordingly includes aligning the one of more dowels to one or more openings on the conveyor frame or the hopper wall configured to receiving the one or more dowels.

A further aspect of the present disclosure provides a method for removing a guard from a conveyor frame or a hopper wall. The guard includes a first support member and a diverter member. The diverter member may have an end attached to the first support member and defining a material diverter surface thereon. The material diverter surface is positioned to direct material away from the conveyor frame or the hopper wall and towards the conveyor system. The diverter member defines an access portion therein and is configured to enclose a fastener assembly therein. The method includes removing the guard from the conveyor frame or the hopper wall by unfastening the fastener assembly that secures the guard to the conveyor frame or the hopper wall through the access portion.

DETAILED DESCRIPTION

Reference will now be made in detail to embodiments of the present disclosure, examples of which are illustrated in the accompanying drawings. Whenever possible, the same or corresponding reference numbers will be used throughout the drawings to refer to the same or corresponding parts.

Figure 1:
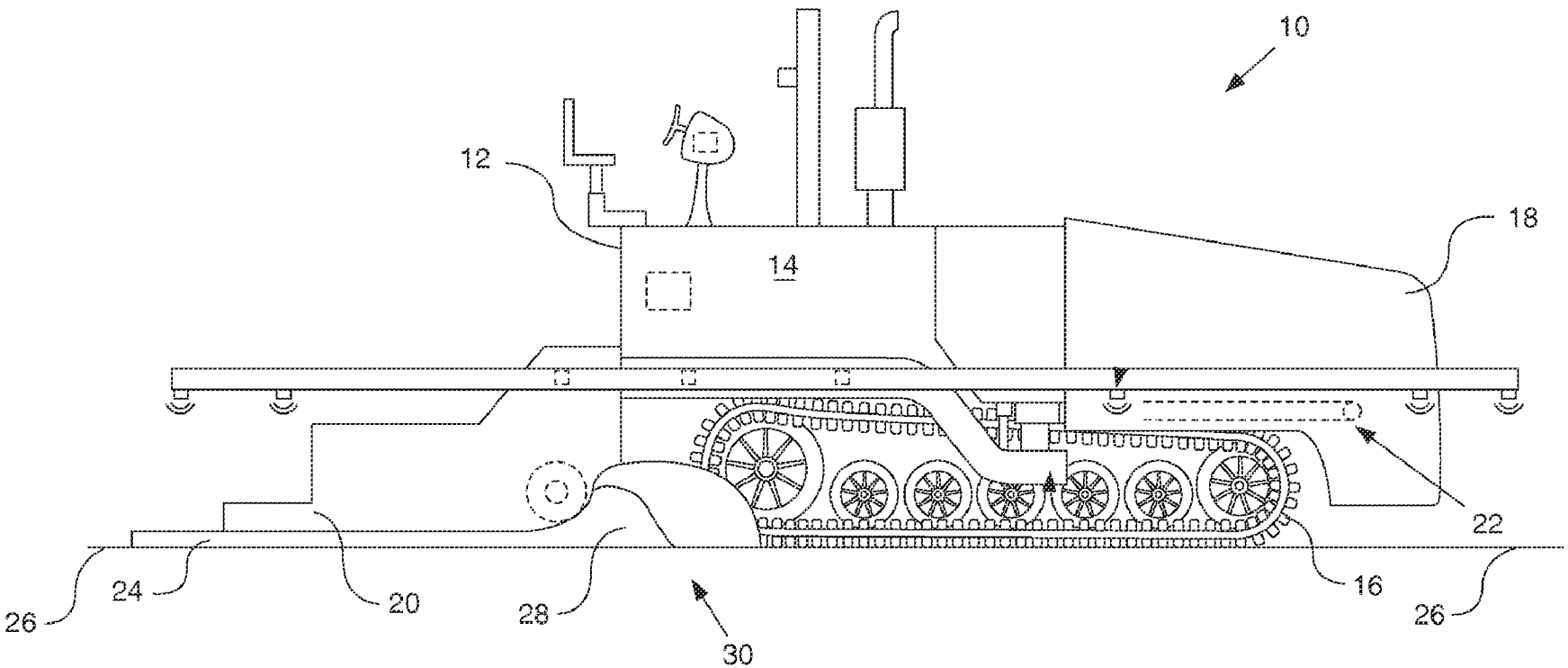
FIG. 1 is a diagrammatic illustration of a paving machine according to an exemplary disclosed embodiment.

FIG. 1 is an illustration of a paving machine 10. Although paving machine 10 is depicted in the figures as an asphalt paver, the presently disclosed guard and guard assembly may be used on any kind of conveyor system for transferring bulk material. Exemplary bulk material to be transferred by the disclosed conveyor system may include asphalt, concrete, or loose aggregate materials such as crushed gravel.

Paving machine 10 may include a tractor 12 having a power source 14, one or more traction devices 16, and a hopper 18 for containing paving material. Paving machine 10 may also include a screed 20 attached to tractor 12 by tow arms and towed behind tractor 12 to spread and compact paving material into a mat 24 on a paving surface 26.

Paving material may be dumped into hopper 18 from trucks that deliver the paving material to a work site. Paving machine 10 may include one or more conveyors 22 at the bottom of hopper 18. Conveyors 22 may be positioned side-by-side, shown as conveyors 103 and 105 in FIG. 2, and run parallel to one another back to the rear of tractor 12. Conveyors 22 may transport paving material from hopper 18 to the rear of tractor 12 where it may be dropped behind tractor 12 in front of screed 20 onto paving surface 26 into a pile 28 (shown in a cut away portion 30 of FIG. 1). As paving machine 10 travels forward, pile 30 may be evenly spread and compacted by screed 20.

The speed of conveyors 22 may be variable to make pile 28 higher or lower. The pile height may be increased or decreased by varying the conveyor speed relative to the speed at which paving machine 10 is traveling. For example, if the conveyor speed is high, relative to the paving machine speed, then paving material may accumulate behind tractor 12 in front of screed 20, thus resulting in a higher pile. If the conveyor speed is low, relative to the paving machine speed, then the paving material may be spread over a longer stretch of paving surface 26, resulting in a lower pile.

The speed of each conveyor may be independently variable. Independently varying the speed of conveyors 22 may enable an increase or decrease in the pile height toward one side of paving machine 10 or the other. This feature may be used to even out an inadvertently lopsided pile or to purposely create a lopsided pile.

Figure 2:
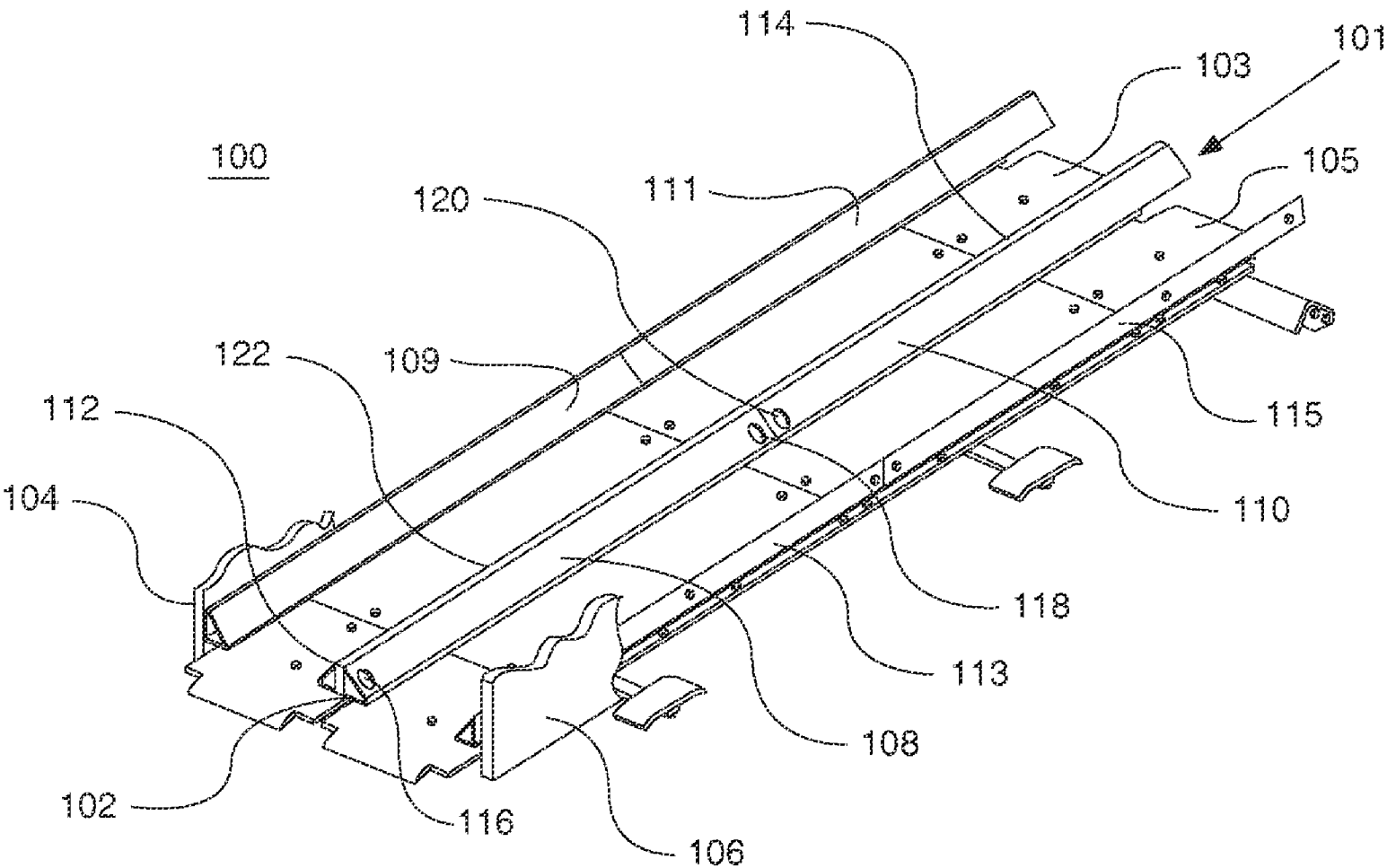
FIG. 2 is a diagrammatic view of a conveyor system of the paving machine shown in FIG. 1, including a guard assembly of four individual guards to protect the center conveyor frame and a guard assembly on either side of the hopper walls.

FIG. 2 depicts a conveyor system 100 according to one disclosed embodiment. The conveyor system 100 includes a center conveyor frame 102, a first hopper wall 104 and a second hopper wall 106. The conveyor system 100 also includes conveyors 103 and 105. A guard assembly 101 of individual guards 108, 110, 112, and 114 protects the conveyor frame 102 and diverts material toward the conveyors 103 and 105.

As illustrated, the guards 108 and 110 are assembled sequentially along and attached to one side of the center conveyor frame 102, whereas the guards 112 and 114 are assembled sequentially along and attached to the opposite side of the center conveyor frame 102. The length of the assembly 101 is sufficient to cover substantially the entire length of the frame 102. Alternatively, the assembly 101 may be shorter and covers only a portion of the frame 102, such as for example, the portion corresponding to the part of the conveyors 103 and 105 receiving material from a dump truck.

A wear strip 122 is positioned at the peak intersection of the guards 108 112, 110 and 114, for the purpose of diverting material away from the centerline of the guard assembly 101 and to protect the center conveyor frame 102. The wear strip 122 can be sufficiently long to cover the entire length of the frame 102. Or, the length of the wear strip 122 can be shortened to cover only a portion of the center conveyor frame 102. The wear strip 122 may be formed of a number of different materials, such as a metal material, a polymer material, or any other material suitable for the bulk material that the conveyor system 100 is designed to receive and transfer.

In addition, the individual guards 109 and 111 are assembled sequentially along and attached to a side of the first hopper wall 104 facing the conveyor 103. The individual guards 113 and 115 are also assembled sequentially along and attached to a side of the second hopper wall 106 facing the conveyor 105.

Figure 3:
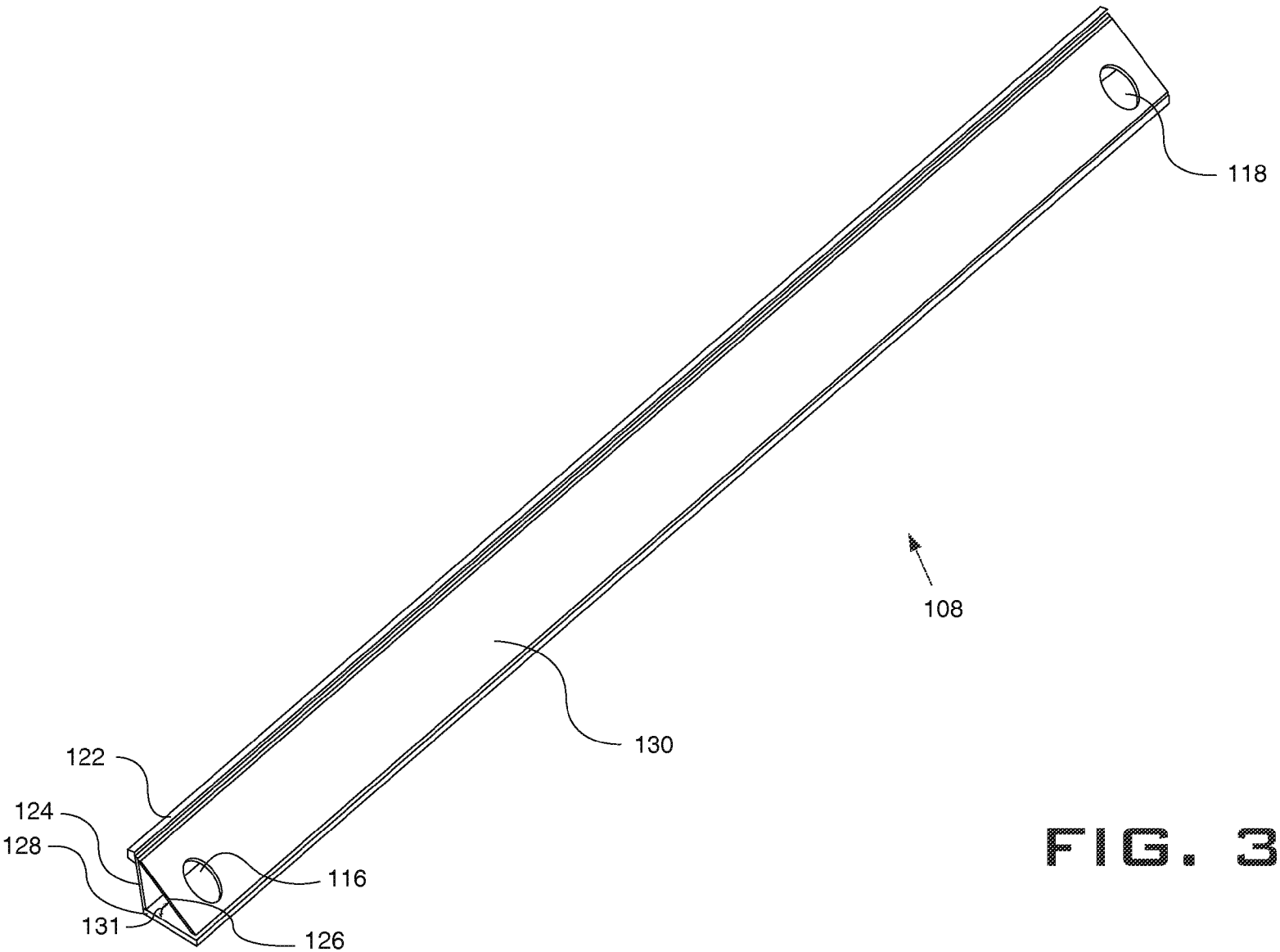
FIG. 3 is a perspective view of an individual guard of the conveyor system shown in FIG. 2, including a wear strip.

Referring now to FIG. 3, which provides an amplified view of the individual guard 108 associated with the wear material 122. The guard 108 includes a first support member 124 and a second support member 128. These two support members 124 and 128 may be formed from channel material or may include two separate plates attached to each other along one side by welding or other means. In the illustrated embodiment, the second support member 128 is in the form of a plate. In alternative embodiments, the second support member may include a gusset.

The guard 108 also includes a diverter member 126, which defines a diverter surface set at an angle 131 relative to the first and second support members 124 and 128. The angle 131 may be set at a value greater than the angle of repose for the bulk material being transferred by the conveyor system 100 to facilitate such material transfer and reduce the amount of the material being left behind. The angle of repose is usually defined as the angle with a horizontal surface formed when free-flowing material comes to rest, and the material within the angle of repose can be a flow barrier.

Figure 4:
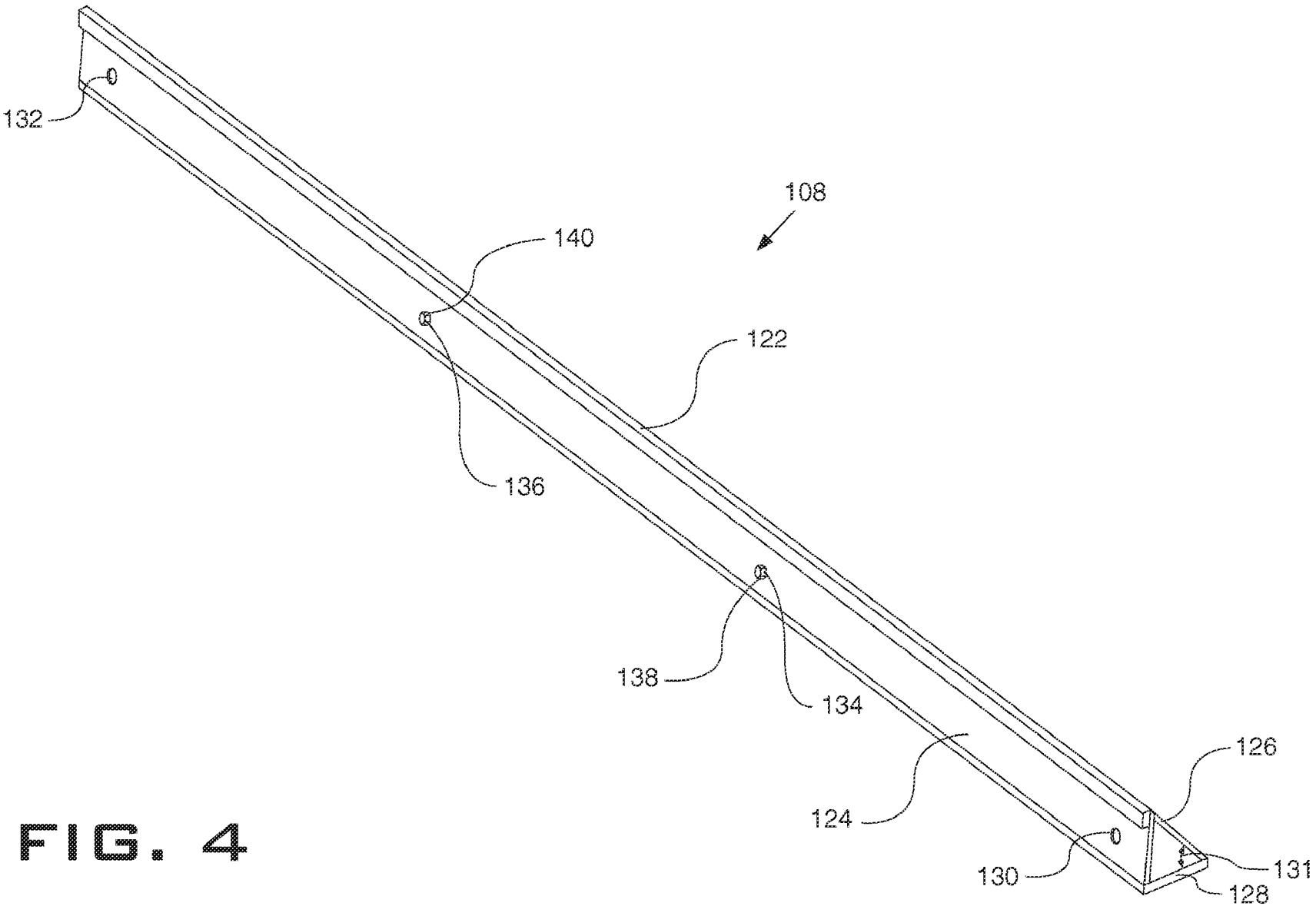
FIG. 4 is a perspective view of the individual guard of the conveyor system shown in FIG. 2, positioned to display the attachment means.
Figure 5:
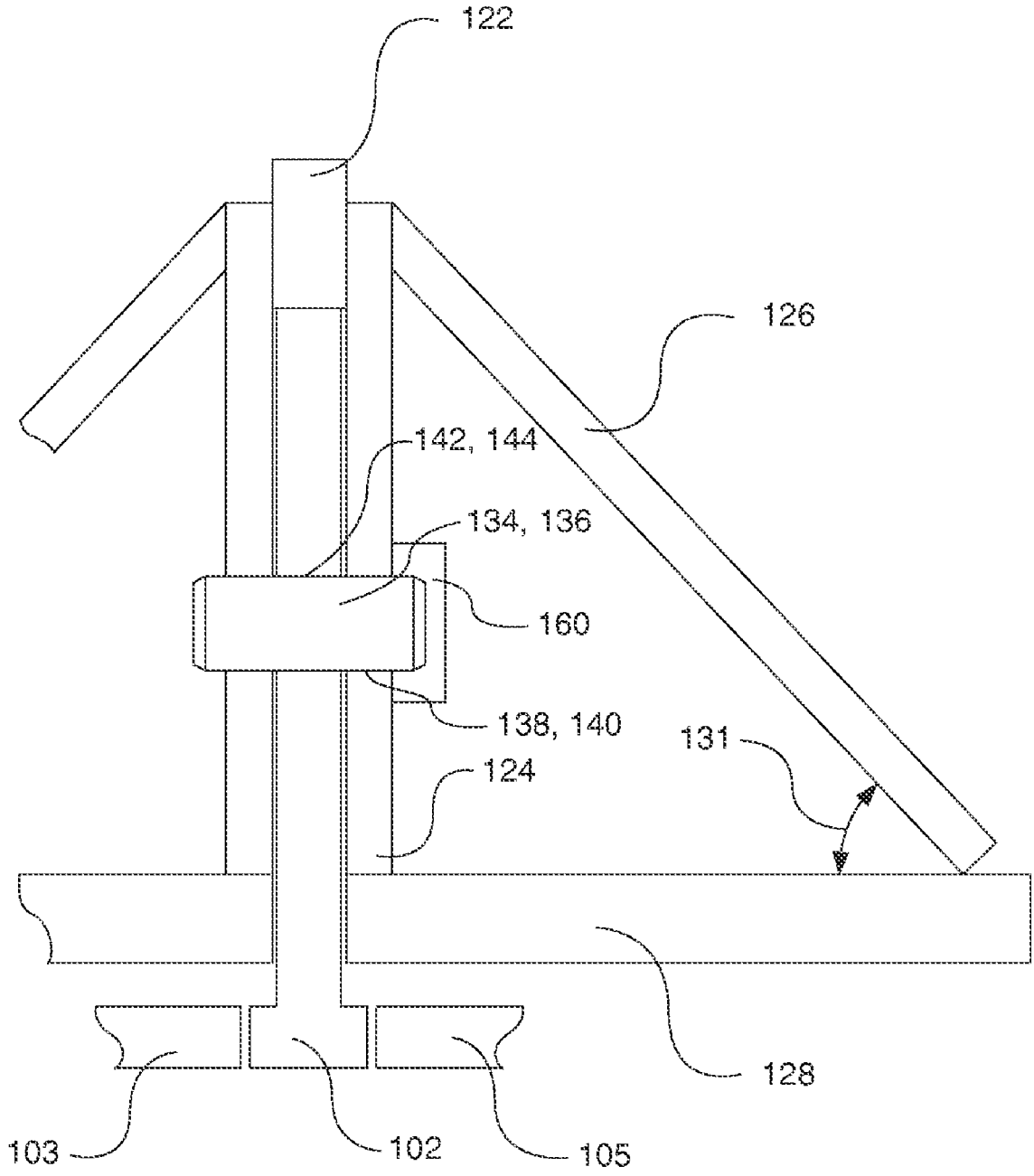
FIG. 5 is a cross-sectional view of the center guard assembly shown in FIG. 2.

The diverter member 126 of the guard 108 also includes first and second apertures 116 and 118, which are horizontally aligned with first and second fastening points 130 and 132 on the first support member 124 (as shown in FIG. 4). The fastening points 130 and 132 are each configured to receive a fastener assembly 160 (shown in FIG. 5) to removeably attach the guard 108 to the center conveyor frame 102. Accordingly, the apertures 116 and 118 provide a window of exposure so that a fastener head can each be engaged through the apertures 116 and 118 by a tool as is customary. This allows the attachment or removal of the guard 108 to the center conveyor frame 102 through a removeable fastener assembly 160 (shown in FIG. 5) in a recessed position relative to the diverter surface. This recessed positioning reduces the exposure of the hardware relative to the abrasive aggregate as it is transferred by the conveyor system. As a result, the conveyors system can be quickly maintained or serviced without destroying the guards or fastening means.

The guard 110 shown in FIG. 2 also includes a diverter member aligned with the diverter member 126 of the guard 108 to form a substantially continuous material diverting surface. An access aperture 120 is included to provide a window of exposure so that a fastener head (not shown) can be engaged through the aperture 120 by a tool as is customary, thereby allowing the attachment or removal of the guard 110 to the frame 102 through a removeable fastener assembly 160 in a recessed position relative to the diverter surface. In the illustrated embodiment, the guard 110 includes one access aperture 120, whereas the guard 108 includes two access apertures 116 and 118. For the guard 110, additional access is available from the back of the machine including the conveyor system 100.

As shown in FIG. 4, the first support member 124 also includes first and second attachment points 134 and 136, which may each include a hole. A pair of dowels 138 and 140 press fit into the holes at the attachment points 134 and 136 to provide rigid support. This feature is further illustrated in FIG. 5, a cross-sectional view of the guard assembly 101. Accordingly, during installation of the guard 108 to the center conveyor frame 102, each of the dowels 138 and 140 aligns with and extends into corresponding holes 142 and 144 on the frame 102. The dowels 138 and 140 then provide additional vertical support for the guard 108 when the conveyor system 100 is receiving bulk material for transfer. The dowel design also facilitates the guard to be piloted onto the dowels for each assembly, and regarding removal of the guard from the frame, there is no fastener to remove rather the dowels pull out directly from the holes in the frame.

In certain embodiments, the guard 112 can be attached to the frame 102 with the same removeable fastener assemblies 160 (through the access apertures 116 and 118) and dowels 138 and 140 that attach the guard 108 to the frame 102. In these embodiments, the guard 112 may include a diverter member that does not have any access apertures. This reduces the number of access apertures of the guard assembly.

Similarly, the guard 114 can be attached to the frame 102 with the same removeable fastener assembly 160 (through the access aperture 120) and dowels that attach the guard 110 to the frame 102. In these embodiments, the guard 114 may include a diverter member that does not have any access apertures. This further reduces the number of access apertures of the guard assembly.

Alternatively, the guard 112 may be a mirror image of the guard 108. The guard 112 may include a diverter member that defines its own access apertures. Fastener assemblies (not shown) different than those used for attaching the guard 108 to the frame 102 may be employed to attach the guard 112 to the frame 102. This may allow completely separate attachment or removal of the guards 108 and 112. Similarly, the guard 114 may be a mirror image of the guard 110 and use a different fastener assembly (not shown), thereby allowing separate attachment or removal of these two guards.

INDUSTRIAL APPLICABILITY

Referring to FIG. 2, the guard assembly 101 of four individual guards 108, 110, 112, and 114 is used to protect, and divert material to the conveyors 103 and 105 away from, the center conveyor frame 102. In addition, an assembly of two guards (109 and 111, or 113 and 115) is used to protect, and divert material to the conveyor 103 or 105 from the first hopper wall 104 or the second hopper wall 106; these two-guard assemblies can be attached or removed to their respective hopper walls by accessing from outside of the machine including the conveyor system 100.

Although the illustrated embodiments are directed to an asphalt paver, the disclosed guard and guard assembly can be adapted to any conveyor system transferring bulk material that may cause wear of certain parts of the conveyor system. The disclosed guard and guard assembly facilitate material transfer by including a diverter member defining a material diverter surface. The material diverter surface is set an angle relative to the conveyor surface, which angle can be configured to be greater than the angle of repose of the material being transferred to facilitate material flow through the conveyor system, reduce the amount of leftover material, and reduce the need to remove build-up leftover material in the conveyor system.

Further, the hardware responsible for attaching and supporting the guard and guard assembly to the conveyor system (e.g., the fastening assembly utilizing the fastening points 130 and 132, and the dowels 138, 140 and their corresponding attachment points 134 and 136) is at a position recessed relative to the material being transferring, thus reducing wear or other damage of the hardware by the material. The use of an assembly of individual guards also allows for individual replacement or repair, which may reduce cost and machine downtime.

For the illustrated asphalt paver, the disclosed guard and guard assembly substantially eliminate hardware (e.g., hardware used to attach the guards to the conveyor system) exposed to asphalt, which decreases the time necessary for cleaning up around the hardware before it can be removed so as to detach the guards from the paving machine. The recessed location of the hardware also reduces its exposure to asphalt, which reduces its wear or damage. The use of dowels in addition to the fastening assemblies also facilitates the installation and removal of the guards.

Further, the guard assembly (including the guards 108, 110, 112, and 114) for the center conveyor frame 102 includes a wear material 122, which provides further protection for the frame 102.

It will be apparent to those skilled in the art that various modifications and variations can be made to the disclosed paving machine output monitoring system without departing from the scope of the invention. Other embodiments of the invention will be apparent to those skilled in the art from consideration of the specification and practice of the invention disclosed herein. It is intended that the specification and examples be considered as exemplary only, with a true scope of the invention being indicated by the following claims and their equivalents.

What is claimed is:

1. A guard for protecting a conveyor frame or a hopper wall and diverting material toward a conveyor system, the guard comprising:

a first support member;

a diverter member having an end attached to the first support member and defining a material diverter surface thereon, the material diverter surface being positioned to direct material away from the conveyor frame or the hopper wall and towards the conveyor system; and a fastener assembly being structured and arranged to secure the first support member to the conveyor frame, wherein the diverter member defines an access portion having at least one aperture therein and is configured to enclose the fastener assembly therein to removably attach the guard to the conveyor frame or the hopper wall.

2. The guard of claim 1, wherein the fastener assembly includes a fastener member with at least one end, the at least one end of the fastener member being disposed within the access portion and recessed relative to the material diverter surface.

3. The guard of claim 2, wherein the access portion of the diverter member is aligned with the at least one end of the fastener member.

4. The guard of claim 1, wherein the support member includes at least one support element configured to removeably attach the support member to the conveyor frame or the hopper wall.

5. The guard of claim 4, wherein the at least one support element includes a dowel.

6. The guard of claim 1 further comprising a second support member having a first end being attached to the first support member and a second end attached to the diverter member.

7. The guard of claim 6, wherein the second support member includes a plate.

8. The guard of claim 6, wherein the second support member includes at least one gusset.

9. The guard of claim 6, wherein the first and second support members are constructed from channel material.

10. A guard assembly comprising at least two guards of claim 1.

11. The guard assembly of claim 10, wherein the at least one diverter member of the at least two guard in and being aligned with the at least one end of the fastener member to removeably attach one guard to the conveyor frame or the hopper wall.

12. The guard assembly of claim 11, wherein the two guards are attached to the opposite sides of the conveyor frame.

13. The guard assembly of claim 12 further comprising a wear material located between the first support members of the two guards attached to the opposite sides of the conveyor frame, the wear material being structured and arranged to protect the conveyor frame.

14. A conveyor system for receiving bulk material therein and directing the bulk material to a selected destination, the conveyor system comprising:

first and second hopper walls and a moveable conveyor belt positioned thereunder;

a conveyor frame to support the moveable conveyor belt; and at least one removeable guard defining a material diverter surface having an aperture therein, the material diverter surface being positioned to direct the bulk material away from the conveyor frame or the first and second hopper walls and towards the moveable conveyor belt;

wherein the at least one guard being removeably attached to the conveyor frame or the first and second hopper walls through a fastener assembly at least partially recessed relative to the material diverter surface.

15. The conveyor system of claim 14, wherein the fastener assembly is accessible through an aperture on the material diverter surface.

16. The conveyor system of claim 14, wherein the at least one guard includes a support member removeably attached to conveyor frame or the first and second hopper walls through at least one support element substantially inaccessible by the bulk material.

17. The conveyor system of claim 16, wherein the at least one support element includes a dowel.

18. The conveyor system of claim 16, wherein the support member includes a plate.

19. The conveyor system of claim 16, wherein the support member includes a gusset.

* * * * *